US005942716A

United States Patent [19]

Miller

[11] Patent Number: 5,942,716

[45] Date of Patent: Aug. 24, 1999

[54] ARMORED VEHICLE PROTECTION

[75] Inventor: Daniel Roderick Miller, Egham, United Kingdom

[73] Assignee: Pilkington Thorn Optronics Limited, United Kingdom

[21] Appl. No.: 08/730,368

[22] Filed: Oct. 15, 1996

[30] Foreign Application Priority Data

Oct. 13, 1995 [GB] United Kingdom ..... 9520979

[51] Int. Cl.[6] ..... F41H 5/007

[52] U.S. Cl. ..... 89/36.17; 89/36.08

[58] Field of Search ..... 89/36.17, 36.02, 89/36.08; 109/49.5

[56] References Cited

U.S. PATENT DOCUMENTS

| | | | |
|---|---|---|---|
| 3,708,194 | 1/1973 | Amit | 293/1 |
| 4,126,312 | 11/1978 | Kreuzer et al. | 273/105.2 |
| 4,262,595 | 4/1981 | Longerich | 89/36.17 |
| 4,543,872 | 10/1985 | Graham et al. | 109/49.5 |
| 4,573,396 | 3/1986 | Streetman et al. | 89/36.08 |
| 5,025,707 | 6/1991 | Gonzalez | 89/36.17 |
| 5,129,323 | 7/1992 | Park | 102/293 |
| 5,249,527 | 10/1993 | Schwind | 102/354 |
| 5,345,238 | 9/1994 | Eldridge et al. | 342/3 |
| 5,424,741 | 6/1995 | Genovese | 342/10 |

FOREIGN PATENT DOCUMENTS

| | | | |
|---|---|---|---|
| 0193507 | 2/1986 | European Pat. Off. . | |
| 0250742 | 4/1987 | European Pat. Off. . | |
| 0715145 | 6/1996 | European Pat. Off. . | |
| 2459633 | 7/1976 | Germany | 89/36.08 |
| 3312169 | 10/1984 | Germany . | |
| 577192 | 5/1946 | United Kingdom . | |
| 2208535 | 4/1989 | United Kingdom . | |
| 1 351 933 | 5/1994 | United Kingdom . | |
| WO 94/04882 | 3/1994 | WIPO . | |
| 9508749 | 3/1995 | WIPO . | |

*Primary Examiner*—Stephen M. Johnson

*Attorney, Agent, or Firm*—Gifford, Krass, Groh, Sprinkle, Anderson & Citkowski, P.C.

[57] ABSTRACT

An arrangement for protecting an armored vehicle from incoming projectiles comprising an inflatable structure (12, 14; 22, 23; 40; 56) for mounting on a vehicle (10; 20; 30; 50). The structure is inflated on detection of an incoming projectile such that the inflated structure extends from the vehicle. The inflated structure may alter the signature of the vehicle as seen by incoming missiles, or may provide a decoy.

9 Claims, 2 Drawing Sheets

Laser designated missile being seduced by an active laser decoy illuminating a MFC.

Laser designated missile being seduced by an active laser decoy illuminating a MFC.

Laser designated missile being seduced by a combination MFC passively redirecting laser radiation.

ARMORED VEHICLE PROTECTION

FIELD OF THE INVENTION

This invention relates to arrangements for use in protecting vehicles, particularly armored fighting vehicles and other military vehicles, from incoming projectiles.

BACKGROUND OF THE INVENTION

It has been proposed to provide armored military vehicles with "explosive" active armor which is activated by the vehicle's defensive aids sensor suite on detection of an incoming missile. The detonation of a charge at or near the vehicle's outer surface produces a shower of fragments which, if correctly timed, will damage the incoming missile before it reaches the vehicle. If however the charge is detonated accidentally, the vehicle is likely to be damaged unnecessarily, and there is a risk of injury to any personnel in the vicinity of the vehicle.

Missiles and other ordnance may be directed towards a target using laser guidance, "laser guided ordnance" being the generic name for this family of weapon systems. These weapons have a laser seeking sensor device which is sensitive to laser radiation scattered by the target. The laser radiation is directed at the target from a distant laser designator which may be on the vehicle launching the laser guided ordnance, on a separate vehicle or on the ground, with a means of communicating with the weapon launching system to synchronize the attack. The illuminating laser radiation is formed into a narrow beam so that only the target is illuminated, and is in the form of a precisely timed pulse train. The laser seeking sensor or "seeker" is generally sensitive only to the laser wavelength in use and only reacts to laser pulse trains with the correct timing characteristics, and may use further discrimination techniques to minimize the susceptibility of the system to a range of decoy techniques.

There are two broad classes of laser guided ordnance. One class is bombs and missiles of the 225–900 kg (500–2000 lb) class, designed for use against large heavy fixed installations. The other class is laser guided missiles, typically used for anti-tank applications. For both classes of ordnance, a target is illuminated by a laser designator. Both types of ordnance are directed towards the scattered reflected laser radiation. Bombs follow a ballistic trajectory and will generally dive onto the target. The large warhead will detonate on or after impact and may cause damage even with a near miss. To protect a large installation against a bomb it is necessary to decoy the seeker sufficiently to cause the bomb to fall many meters from the point illuminated by the laser designator. On the other hand, laser guided anti-tank missiles generally follow a flat trajectory and will only damage the target seriously if they achieve a direct hit. To protect a vehicle, particularly a tank or other armored vehicle, against laser guided anti-tank missiles, it is therefore only necessary to cause the missile to deviate sufficiently to prevent a direct hit.

Existing laser repeater decoys illuminate a point near the target with a pulse train from a laser which is triggered by receipt of incoming laser pulses. The repeater pulse is arranged to go out very quickly after the received pulse so that timing circuits in the seeker are unable to discriminate against the decoy from the pulse interval. To minimize the time of flight difference between the real and decoy lasers, the decoy is usually thrown forward of the target towards the incoming threat. The laser energy of the decoy as seen by the seeker also needs to be stronger than the return from the real designating beam to ensure the seeker accepts the decoy rather than the real designator. Finally, if the decoy is placed too far from the real target, the seeker may not see it or may be able to determine that the decoy is not the correct target. In a prepared position the geometry and energy levels can be determined and a suitable decoy location selected. However, in the case of a mobile vehicle this is much more difficult, particularly since the vehicle will often position itself behind ground or vegetation cover which would block or attenuate the decoy signal to a missile seeker.

It is among the objects of embodiments of the present invention to provide an arrangement for protecting vehicles against incoming projectiles which does not require such precise timing as the existing active armor countermeasures described above, and which will not present a danger to personnel in the event of accidental activation.

It is among the objects of further embodiments of the present invention to provide an arrangement for implementing a laser decoy which will be effective in protecting vehicles against laser anti-tank missiles.

SUMMARY OF THE INVENTION

According to the present invention there is provided an arrangement for protecting a vehicle from incoming projectiles, the arrangement comprising an inflatable structure for mounting on a vehicle; and means for inflating the structure on detection of an incoming projectile such that the inflated structure extends from the vehicle.

This countermeasure or decoy arrangement will typically be linked to the vehicle's defensive aids sensor suite, which detects the presence of incoming missiles. This permits automatic deployment of the structure immediately a missile is detected. For certain embodiments, an incoming projectile may be detected indirectly, for example, by the detection of an incoming laser pulse from a laser designator associated with laser guided ordnance.

The use of an inflatable structure allows rapid deployment of the structure in the limited period between detection of a incoming projectile and the projectile reaching the vehicle. The technology to provide such rapid deployment is already widely available and in use in, for example, vehicle airbag inflation arrangements. Inflation of the structure may be achieved by one or both of detonation of sodium azide charge and release of high pressure gas. As the former tends to heat the structure and the latter tends to cool the structure, a combination of both inflation methods allows the thermal image of the inflated structure to be controlled.

In one embodiment the structure has the same or similar infra-red (IR) or radar reflectivity as the vehicle surface and this may be achieved by, for example, metallizing the surface of the structure or by including a reflective shield in the structure. Thus, for example, an incoming missile equipped with an active IR fuse will be prematurely triggered before reaching the optimum stand-off distance, thus reducing the damage to the vehicle.

In a further embodiment, the inflated structure may include rigid or semi-rigid elements, or may serve to erect a rigid or semi-rigid element, such as a solid plate. These elements may be utilized to trigger missiles with contact fusing systems, before the missile contacts the vehicle armor.

In another embodiment, the inflated structure may alter specific characteristics of the vehicle profile to deny target recognition by anti-tank guided weapons; such weapons are equipped with range finding optics which detonate the missile on detecting the specific optical signature produced as the missile flies over a tank, thus exploiting the relatively weak top armor. Specifically, the range-finding optics recognize the large ground to hull step change and the smaller hull to turret change, and these may be disguised or altered by appropriately configured structures.

In an embodiment for implementing a laser decoy, the inflatable structure is deployed on detection of an incoming designator pulse train and is inflated to extend upwardly above the roof of the vehicle. The surface of the inflated structure preferably bears a visual camouflage, matched to the vehicle. Most preferably, the surface of the inflated structure has high diffuse scattering characteristics at the laser designator wavelengths, currently around 1.06 microns. The arrangement may include a laser repeater which is triggered by incoming laser pulse trains to illuminate the inflated structure, scattering the energy from the laser repeater and thus providing a decoy above the vehicle. The incoming missile will tend to fly through the inflated structure which may collapse or shred under impact, or may act to destabilize the missile so that it topples and crashes close behind the vehicle, or may cause the missile fuse to detonate causing the missile to self-destruct. The radiation from the laser repeater may be directed upwardly into the interior of the inflated structure, towards the exterior of the inflated structure from elsewhere on the vehicle, or into a group of optical conductors, such as optical fibers, mounted on the inflatable structure and terminating at locations on the structure.

In another laser decoy embodiment, a first inflatable structure is provided for deflecting incoming laser energy from a designator and a second inflatable structure is provided for deployment above the vehicle for collecting the reflected radiation and scattering this radiation so that it may be detected by a missile seeker. Preferably, the first inflatable structure inflates to define a sloping skirt around the vehicle, and has high specular reflectivity and low diffuse reflectivity.

These embodiments may be provided individually or combined together.

The invention also relates to a vehicle provided with one or more arrangements as described above.

BRIEF DESCRIPTION OF THE DRAWINGS

These and other aspects of the present invention will now be described, by way of example, with reference to the accompanying drawings, in which.

DETAILED DESCRIPTION OF PREFERRED EMBODIMENTS

Figure 1:
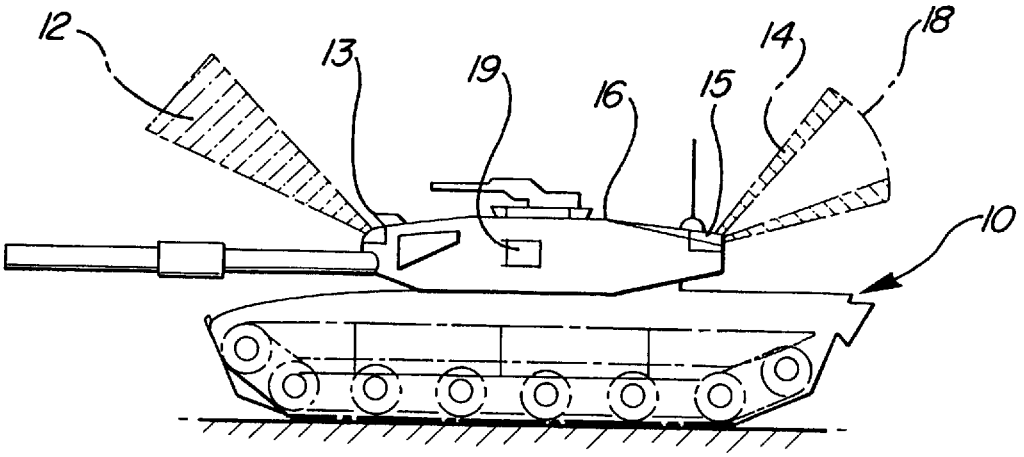
FIG. 1 is a schematic side view of an arrangement for protecting an armored vehicle from incoming missiles in accordance with a first embodiment of the present invention.

Reference is first made to FIG. 1 of the drawings which illustrates an arrangement for protecting an armored vehicle, in this example a tank 10, from incoming proximity fusing missiles. Such missiles include active infra-red (IR) or radar fuses which are primed to detonate a few meters short of the target, to provide time for the explosion to develop and optimize penetration depth.

The arrangement includes one or more rapidly inflating airbags 12, 14 including material having the same IR and radar reflectivity as the tank 10. Thus, the active fuse on the incoming projectile will be prematurely triggered and armor penetration significantly reduced. The airbags 12, 14 are inflated, by respective inflation devices 13, 15, towards the incoming projectile and in this example the airbags and inflation devices are shown mounted on the tank turret 16. One of the illustrated airbags 12 is in the form of a simple cone, whereas the other airbag 14 is utilized to erect an IR or radar reflective shield 18.

Inflation of the airbags 12, 14 is cued by a sensor 19 in the defensive aids suite of the tank, and due to the short time interval between detection of an incoming missile and contact with the tank 10, the airbags 12, 14 are deployed rapidly and automatically immediately following missile detection.

Figure 2:
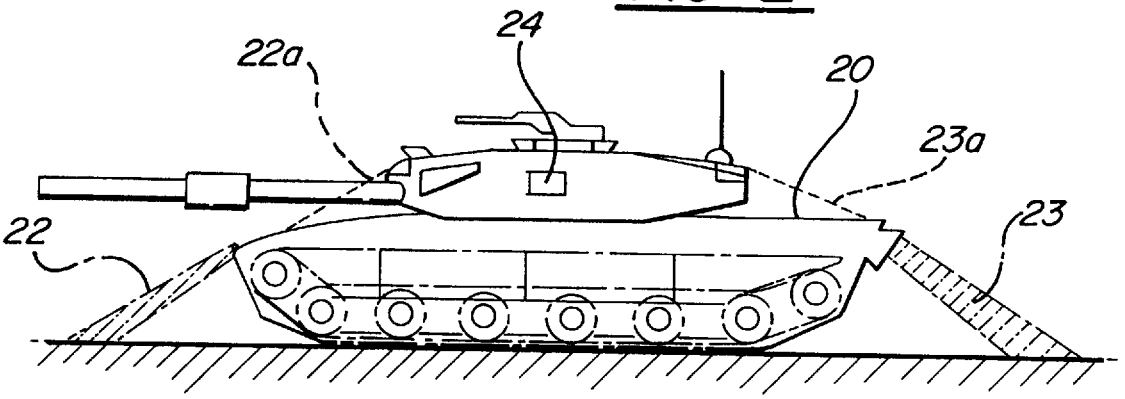
FIG. 2 is a schematic side view of an arrangement for protecting an armored vehicle from incoming missiles in accordance with a second embodiment of the present invention.

Reference is now made to FIG. 2 of the drawings, which illustrates an arrangement in accordance with a second embodiment of the invention. This arrangement is intended to "disguise" the tank 20 from anti-tank guided weapons (ATGW) including range finding optics which recognize a tank profile as the weapon passes over the tank. Such missiles are intended to detonate above the vehicle, to exploit the relatively weak top armor. Due to the altered profile of the tank, the weapon will thus pass over the tank 20 without detonating, such that this arrangement is particularly useful for vehicles protected by light armor.

In the illustrated example airbags 22, 23 extend outwardly and downwardly from the front and rear of the tank to disguise the large ground to hull step change. Further airbags 22*a*, 23*a* may also be provided to disguise the smaller hull to turret step change.

As with the first described embodiment, the airbags 22, 23 are inflated immediately an incoming missile is detected by the defensive aids suite of the tank 24.

From the above-described embodiments it will be apparent to those of skill in the art that the timing of the deployment of the described countermeasures is not as critical as in active armor countermeasures. Further, accidental activation of the airbag inflation means presents minimal risk to personnel and will not result in damage to the vehicle.

Figure 3:
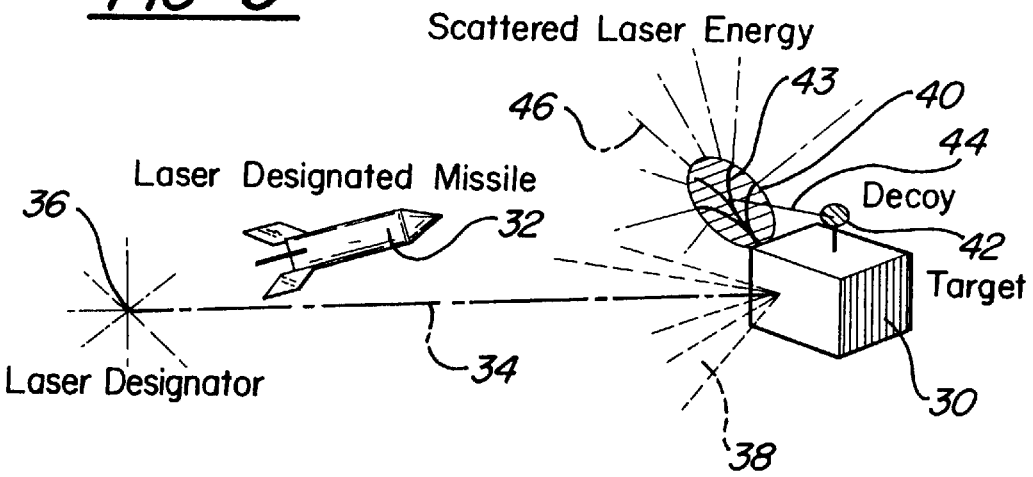
FIGS. 3 and 4 are schematic views of arrangements for protecting armored vehicle from incoming laser guided missiles in accordance with third and fourth embodiments of the present invention.

Reference is now made to FIG. 3 of the drawings which is a schematic illustration of an arrangement for protecting an armored target vehicle from incoming laser guided missiles in accordance with a third embodiment of the present invention. The figure illustrates a laser designated missile 32, which includes a sensor device which is sensitive to laser radiation scattered by the target 30. The laser radiation 34 is pointed at the target 30 from a distant laser designator 36 on the vehicle launching the guided missile 32. The illuminating laser radiation is formed into a narrow beam 34 so that only the target vehicle 30 is illuminated, and is in the form of a precisely timed pulse train. The laser seeking sensor or seeker provided on the missile 32 only reacts to the laser wavelength in use and to laser pulse trains with the correct timing characteristics.

The target 30 is illuminated by the laser designator 36 and in normal circumstances the seeker on the missile 32 is directed towards the scattered laser radiation 38 reflected by the target 30.

Existing laser repeater decoys illuminate a decoy point near the target 30 with a pulse train from a laser which is triggered by receipt of incoming laser pulses. However, in this embodiment of the present invention, the decoy is provided by an inflatable structure 40 mounted on the target vehicle 30. The structure is inflated and deployed upwards above the vehicle 30. The material forming the outer surface of the structure 40 is selected to provide a suitable visual camouflage and has very high diffuse scattering characteristics at the laser designator wavelength (1.06 microns). As in conventional laser decoy systems, a laser repeater 42 is triggered by the incoming laser pulse train 34. However, in this embodiment of the present invention, the pulse train 44 issuing from the laser repeater 42 is directed into the inflated structure 40, which scatters the laser energy, providing a strongly illuminated decoy source directly above the target vehicle 30. As the decoy is located directly above the target vehicle 30, the decoy geometry is intrinsically optimum for minimum time of flight difference, minimum angle selectivity and maximum apparent brightness of the decoy relative to the true designator pulse train.

When the laser designated missile 32 detects the scattered radiation 46 emitted by the decoy 40 the missile 32 will change its flight path to avoid the target vehicle 30 and will tend to fly through the inflated structure 40, which will shred and collapse under the impact.

As the decoy structure 40 is positioned above the target vehicle the "miss" distance may be closely controlled. The illuminated structure 40 is visible to missiles approaching from all directions, and directing the laser energy 44 into the structure ensures that the scattered energy 46 is emitted in all directions. However, in other embodiments the structure may be illuminated externally, allowing a laser 42 fitted to the vehicle for other purposes to be used to illuminate the decoy 40, or the laser energy may be conducted through an array of optical fibers 43 between the laser 42 and the structure 40, which fibers conduct the laser energy 44 to the desired position within or on the surface of the structure 40.

Figure 4:
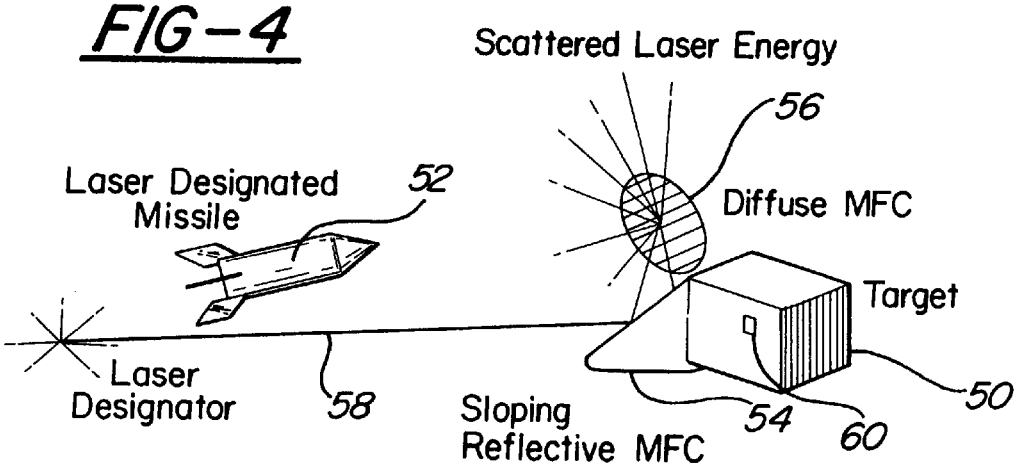

Reference is now made to FIG. 4 of the drawings, which is a schematic illustration of an arrangement for protecting an armored vehicle from an incoming laser guided missile in accordance with a fourth embodiment of the present invention. Like the third embodiment described above, this embodiment of the invention creates a laser emitting decoy, but this is achieved without provision of a laser repeater.

The target vehicle 50 is provided with first and second inflatable structures 54, 56, the first structure 54 being in the form of a sloping skirt which is inflated and deployed around the vehicle 50 and is formed of a material having high specular reflectivity and low diffuse reflectivity. The second inflatable structure 56 is arranged to be deployed above the target vehicle 50 and has a surface provided a high diffuse scattering co-efficient.

In use, the structures 54, 56 are inflated on detection of an incoming designator pulse train 58 by an appropriate sensor 60. The incoming laser energy is deflected upwardly by the first structure 54, greatly reducing the radiation scattered in the direction of an incoming missile seeker 52. The second structure 56 collects the reflected radiation and scatters the radiation so that it can be detected by the missile seeker. The seeker then aims at the higher second structure 56 which is now the strongest source of scattered laser light.

From the above-described embodiments it will be apparent to those of skill in the art that these decoy arrangements provide a simple yet effective means of protecting armored vehicles against laser designated missiles.

It will also be apparent to those of skill in the art that the above-described embodiments are merely exemplary of the present invention, and that various modifications and improvements may be made thereto, without departing from the scope of the invention.

We claim:

1. An arrangement for protecting a vehicle from incoming projectiles, the arrangement comprising an inflatable structure for mounting on a vehicle; and means for inflating the structure on detection of and incoming projectile such that the inflatable structure extends from the vehicle, a sensor for detecting the presence of incoming missiles and wherein the sensor detects incoming laser radiation from a laser designator associated with laser guided ordnance.

2. The arrangement of claim 1 wherein the inflatable structure is deployed on detection of said incoming laser radiation and is inflated to extend upwardly above the vehicle.

3. The arrangement of claim 2, wherein a surface of the inflatable structure bears a visual camouflage.

4. The arrangement of claim 2, wherein the surface of the inflatable structure has high diffuse scattering characteristics at laser designator wavelengths.

5. The arrangement of claim 2 in combination with a laser repeater which is triggered by incoming laser radiation to illuminate the inflatable structure.

6. The arrangement of claim 5, wherein the radiation from the laser repeater is directed upwardly into the interior of the inflatable structure.

7. The arrangement of claim 5, wherein the radiation from the laser repeater is directed towards the exterior of the inflatable structure.

8. The arrangement of claim 5, wherein the radiation from the laser repeater is directed into a group of optical conductors mounted on the inflatable structure and terminating at locations in or on the structure.

9. An arrangement for protecting a vehicle from incoming laser guided ordnance utilizing laser designators, the arrangement comprising an inflatable structure for mounting on said vehicle; means for inflating the structure on detection of incoming ordnance to form an inflated structure extending upwardly from the vehicle, the surface of the inflated structure having high diffuse scattering characteristics at laser designator wavelengths; and a laser repeater to illuminate the inflated structure.

* * * * *